US005209171A

United States Patent [19]

Anderson

[11] Patent Number: 5,209,171

[45] Date of Patent: May 11, 1993

[54] CARPET EDGE BINDING MACHINE

[76] Inventor: Martin L. Anderson, Rte. 3, Box 60, Maple Lake, Minn. 55358

[21] Appl. No.: 871,739

[22] Filed: Apr. 21, 1992

[51] Int. Cl.[5] ..... D05B 23/00; D05B 29/08

[52] U.S. Cl. ..... 112/7; 112/137; 112/153; 112/227; 112/318

[58] Field of Search ..... 112/7, 9, 10, 11, 136, 112/137, 141, 152, 153, 227, 235, 236, 306, 307, 308, 318

[56] References Cited

U.S. PATENT DOCUMENTS

| | | | |
|---|---|---|---|
| 600,502 | 3/1898 | Allen | 112/7 |
| 2,075,656 | 3/1937 | Paternayan | 112/7 X |
| 2,156,535 | 5/1939 | Kucera | 112/235 X |
| 2,547,821 | 4/1951 | Hartwell | 112/7 |
| 2,560,334 | 7/1951 | Enos | 112/9 X |
| 2,575,327 | 11/1951 | Ashley et al. | 112/7 |
| 2,600,597 | 6/1952 | Winberg | 112/60 |
| 2,876,720 | 3/1959 | Sokoloff | 112/9 |
| 3,018,746 | 1/1962 | Winberg | 112/235 X |
| 3,221,685 | 12/1965 | Greenberg | 112/9 X |
| 3,282,237 | 11/1966 | Niekraweitz | 112/227 X |
| 3,855,955 | 12/1974 | Strang | 112/308 X |
| 3,889,614 | 6/1975 | Nicolay et al. | 112/318 |
| 4,062,307 | 12/1977 | Michelberger | 112/7 |
| 4,292,907 | 10/1981 | Gilbride et al. | 112/236 |
| 4,349,142 | 9/1982 | Soter, III | 112/153 X |
| 5,020,458 | 6/1991 | Michelberger | 112/7 |

FOREIGN PATENT DOCUMENTS 2551712 5/1977 Fed. Rep. of Germany ..... 112/7

*Primary Examiner*—Clifford D. Crowder
*Assistant Examiner*—Israel Izaguirre
*Attorney, Agent, or Firm*—Haugen and Nikolai

[57] ABSTRACT

A machine for sewing a binding tape to a cut edge of carpeting comprises a wheel-mounted sewing machine having an opposed pair of pinch rollers engaging opposed sides of the carpeting, the pinch rollers being inset from the cut edge and one of the rollers being intermittently motor driven in synchronism with the reciprocating movement of the sewing machine's needle assembly. As the one pinch roller is driven, the sewing machine moves along the floor as the binding tape is played from a reel, folded longitudinally and stitched to the carpet edge. The machine incorporates a spring-biased needle guide which effectively surrounds the needle shank as it moves reciprocally up and down to create the stitches. This guide prevents deflection of the needle and possible breakage thereof should it encounter a hard object, such as a glue bead or the like in the carpet backing. The wheels on which the sewing machine rides are mounted on the bottom on a pan-shaped base which supports the sewing machine and prevents soiling of the carpet by lubricating grease. The pan-shaped base also shields certain of the mechanical linkages of the sewing machine from damage incident to rough handling.

8 Claims, 2 Drawing Sheets

CARPET EDGE BINDING MACHINE

BACKGROUND OF THE INVENTION

I. Field of the Invention

This invention relates generally to sewing machine apparatus, and more particularly to a sewing machine especially designed to append binding or bias tape to the cut edge of a carpet to prevent fraying of that edge.

II. Description of the Related Art

When a piece of floor carpeting is cut from a larger roll, it is usually necessary to treat the cut edge to prevent the pile fibers of the carpet from unraveling or otherwise becoming frayed. One approach at treating the carpet edge is to affix binding tape about the cut edge, conventionally by longitudinally folding the binding tape over the cut edge and then sewing the binding tape to the carpet edge.

The closest prior art of which applicant is aware comprises a machine sold by the Newark Caplan Company of Newark, N.J. It is especially designed to sew a fabric binding tape onto the cut edge of the carpet. It comprises a motor-driven sewing machine, which is arranged to play out from a reel, a flat strip of binding fabric. It is fed through a former which causes the strip to be folded along a longitudinal midline of the tape as it is positioned over the edge of the carpeting. The sewing machine is conventional in the sense that it incorporates a thread-carrying bobbin beneath a baseplate, and mounted atop the baseplate is a sewing machine arm which supports a needle assembly for reciprocating vertical motion. The bobbin is generally stationary, but surrounding it is a rotatable hook which functions to pull a loop of thread from the sewing machine's reciprocating needle about the bobbin so as to capture the thread exiting the bobbin to create a lockstitch. Because the carpeting is too large and heavy to be fed past a stationary sewing machine, the carpet binding machine sold by the Newark Caplan Company is wheel-mounted and designed to move along the floor of the room relative to the stationary carpet edge. The movement is achieved by providing a motor-driven, carpet-engaging roller disposed on the machine arm above the baseplate and adapted to engage the pile side of the carpeting. Exposed through an opening in the baseplate and cooperating with the carpet backing are conventional sewing machine feed dogs, which engage the carpet's backing material and move in synchronism with the upper drive rollers to step the machine along the carpet's edge as the sewing machine needle reciprocates to develop the lock stitches.

The Newark Caplan Company carpet binding machine suffers from a number of inherent design problems, including its propensity to: (1) damage the carpet, (2) "walk" off of the carpet edge; and (3) its difficulty to steer during use. Furthermore, needle breakage tends to be excessive.

Carpet damage is due to two separate problems. In the prior art Newark Caplan binding machine, the underside of the baseplate is totally open, such that many of the parts of the sewing machine that require lubrication are exposed. The oily surfaces, should they come into contact with the carpet being installed, can produce unsightly soiling. Moreover, the serrated feed dogs which engage the undersurface of the carpeting during use have been found to "chew up" certain backing materials, such as, sponge rubber foam.

The difficulty in steering and manipulating and the propensity of the machine to "walk" off the carpet edge is due to the configuration and placement of the serrated feed rollers which engage the pile surface of the carpeting. In the Newark Caplan machine, these feed rollers are offset a substantial distance in the downstream direction relative to the needle and only a fraction of the rollers actually engage the carpeting, with the remaining portion riding over the carpet edge. When it is considered that steering of the carpet binding machine during use involves having to pivot the machine about the reciprocating needle, the fact that the carpet-engaging drive rollers are displaced a substantial lateral distance downstream of the needle inhibits the ability of the operator to easily rotate the machine about the needle as a center. Compounding the steering problem is the fact that this prior art machine uses a pistol grip style handle affixed midway between the ends of the machine. This makes it more difficult to pivot at a carpet corner.

Because the Newark Caplan machine utilizes a conventional bifurcated presser foot to force the carpeting against the underlying feed dogs and because the needle reciprocates between the two prongs of the presser foot, it is subject to substantial sideways deflection should it strike a hard object, such as a bead of latex in the carpet backing. If the needle becomes deflected during its stroke, it may miss the aperture between the feed dogs through which it is intended to pass during its stroke, resulting in breakage.

It is accordingly a principal object of the present invention to obviate all of the foregoing drawbacks of the prior art carpet binding machine.

Another object of the invention is to provide a carpet binding machine for sewing binding tape along the edge of a carpet which does not cause damage to the carpet itself.

Still another object of the invention is to provide an improved carpet binding machine for sewing binding tape along the cut edge of a carpet which protects the carpet from soiling and which shields the working parts of the sewing machine from the build up of lint and other debris.

Yet another object of the present invention is to provide a carpet binding machine for sewing binding tape to the cut edge of a carpet which provides means for preventing needle breakage.

A still further object of the invention is to provide a carpet binding machine for sewing binding tape to the cut edge of a carpet where the machine may be more readily steered and less subject to walking off of the carpet edge.

A still further object of the invention is to provide a carpet binding machine for sewing binding tape to the cut edge of a carpet and which incorporates a needle guide for preventing sideways deflection of the needle during use.

SUMMARY OF THE INVENTION

The foregoing objects and advantages of the invention are achieved by providing a carpet binding machine of the type comprising a supply of fabric binding tape, a wheel-mounted sewing machine having a baseplate supporting a machine arm on the upper surface thereof, the machine arm having a needle assembly mounted therein along with a drive motor for reciprocally moving the needle assembly in a generally vertical direction to generate stitches along with a feed roller assembly adapted to engage the carpet to be bound and, when driven intermittently by the drive motor, advances the sewing machine along the edge of the carpet. A binding tape forming device is mounted on the baseplate for folding the binding tape over the exposed edge of the carpet to be bound as the sewing machine is advanced along the edge of the carpet and the stitches are applied to the binding tape and carpet. In accordance with the present invention, the feed roller is journaled for rotation about an axis offset only slightly laterally relative to the axis of movement of the needle assembly so that there is only a short distance between the needle and the line of contact between the feed roller and the carpet. Moreover, the feed roller is offset a predetermined distance inward of the exposed edge of the carpeting rather than overlaying the edge. Instead of incorporating conventional feed dogs for engaging the backing side of the carpeting, a simple idler roller is utilized. The present invention also includes a needle guide which is coupled to move with the needle bar to which the sewing machine needle is clamped and the needle guide includes a foot member having an aperture therein for receiving the sewing machine needle therethrough. Because the needle is at all times during its stroke surrounded by the needle guide, it prevents undesired sideways deflection of the sewing machine needle should it encounter a hard spot in the carpeting.

A pan-shaped base is affixed to the undersurface of the baseplate and the pan-shaped base has a generally closed bottom shielding the underside of the baseplate and preventing lubricating oil or grease used on the sewing machine from smudging the carpeting. Affixed to the pan-shaped base are the wheels which support the machine and allow it to readily travel over the floor surface as the feed rollers intermittently rotate in synchronism with needle movement. A handle is affixed to the pan-shaped base and extends at a predetermined angle to the horizontal allowing the operator to more readily manipulate the machine during use.

BRIEF DESCRIPTION OF THE DRAWINGS

The foregoing features, objects and advantages of the invention will become more apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
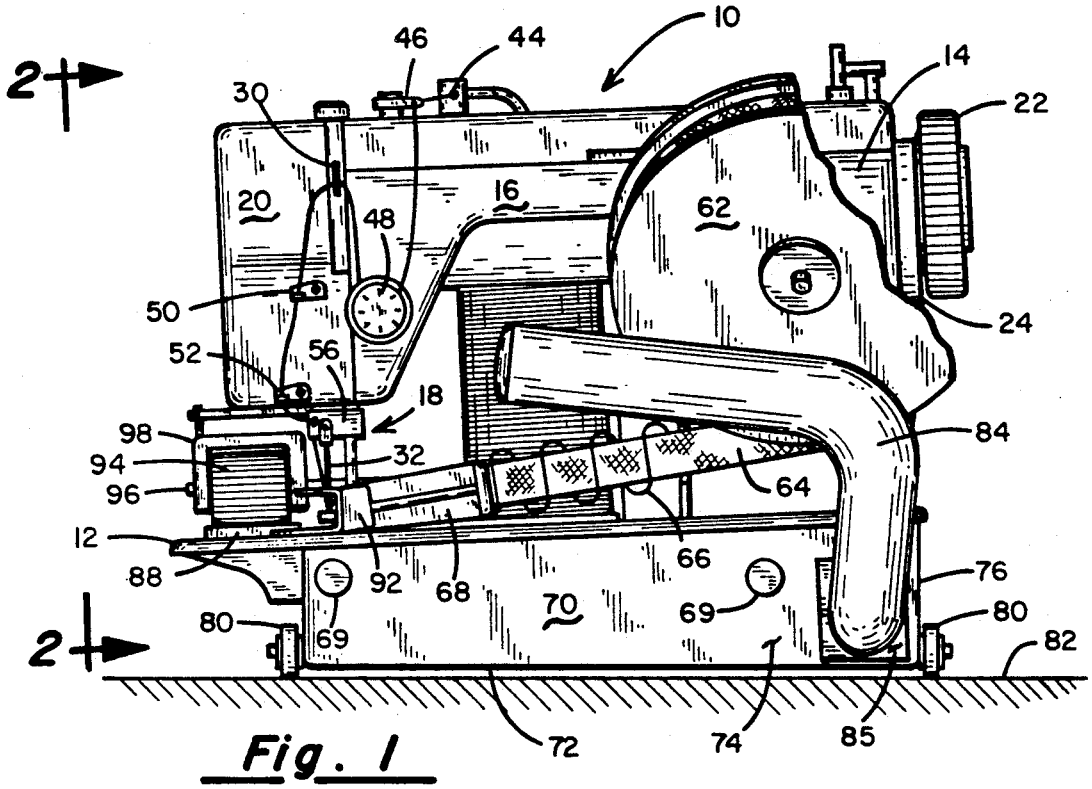
FIG. 1 is a front view of the carpet binding machine of the present invention.

Referring to FIG. 1, there is indicated generally by numeral 10 a carpet binding machine incorporating the present invention. It is seen to comprise a generally planar baseplate 12 on whose upper surface is attached a sewing machine housing 14 including an overhead arm portion 16 which supports a reciprocating needle assembly 18 within a hinged end cover 20.

Figure 3:
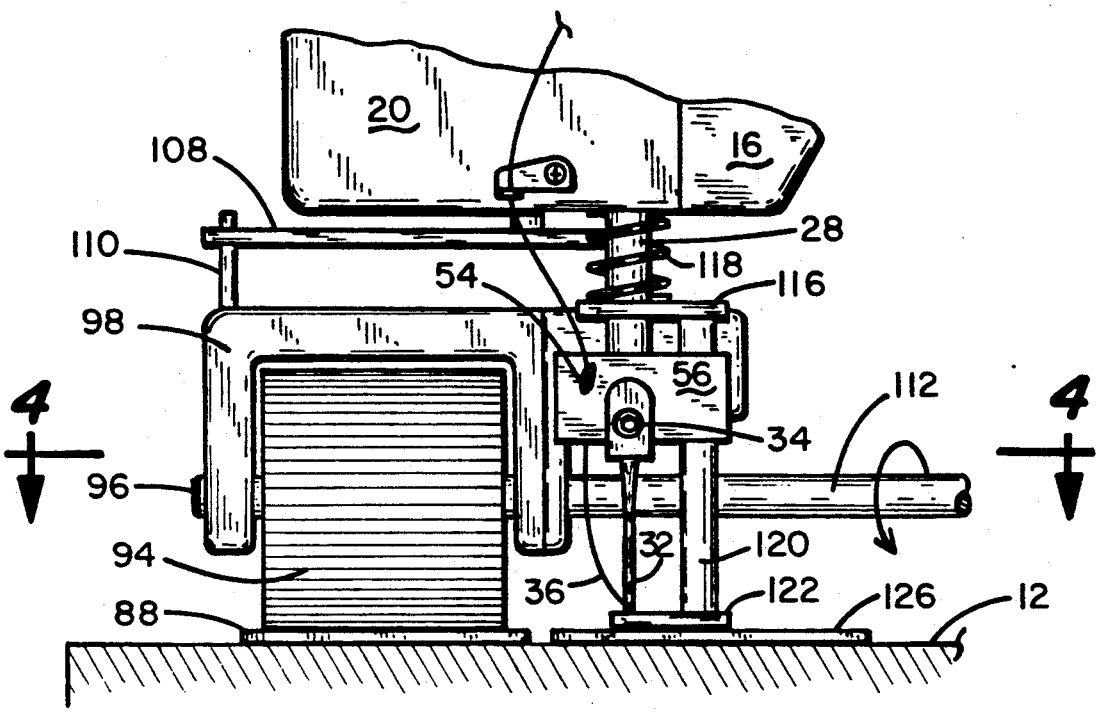
FIG. 3 is an enlarged partial view of a portion of the sewing machine of FIG. 1 illustrating the needle guide assembly and the feed roller assembly.

Projecting outward from the right end of the housing 14, when viewed as in FIG. 1, is a flywheel 22 around which a V-belt 24 extends, the V-belt also encircling a pulley (not shown) mounted on the output shaft of an electric motor 26. The flywheel 22 is coupled to an upper shaft (not shown) contained within the arm portion 16 of the housing, and secured to that shaft is a cam and linkage for driving the needle bar 28 (FIG. 3) and the thread take-up lever 30 in a reciprocating, vertically-oriented path. A sewing machine needle 32 is clamped to the lower end of the needle bar 28, as by setscrew 34. It carries a thread 36 pulled from the spool 38 through the materials to be sewn and below the baseplate 12. Disposed beneath the baseplate 12 is a rotary hook 40 that surrounds a stationary, thread-carrying bobbin 42. The rotary hook causes the thread exiting the needle to be looped about a separate thread emanating from the bobbin 42 and which is pulled back up through the material to form a lock stitch as the needle retracts. More particularly, the thread 36 is seen as passing through a guide tube 44 affixed to the arm 16 and thence through a spring-loaded thread guide 46 and a thread tensioning device 48 and thence through an aperture formed through the thread take-up lever 30. From there, the thread 36 traverses guides 50 and 52 affixed to the hinged end cover 20 and thence through a bore 54 formed in a guide bearing 56 which is fixedly secured to the lower end portion of the needle bar 28. After leaving the bottom of the bore 54, the thread 36 passes through the eye of the needle 32.

Figure 2:
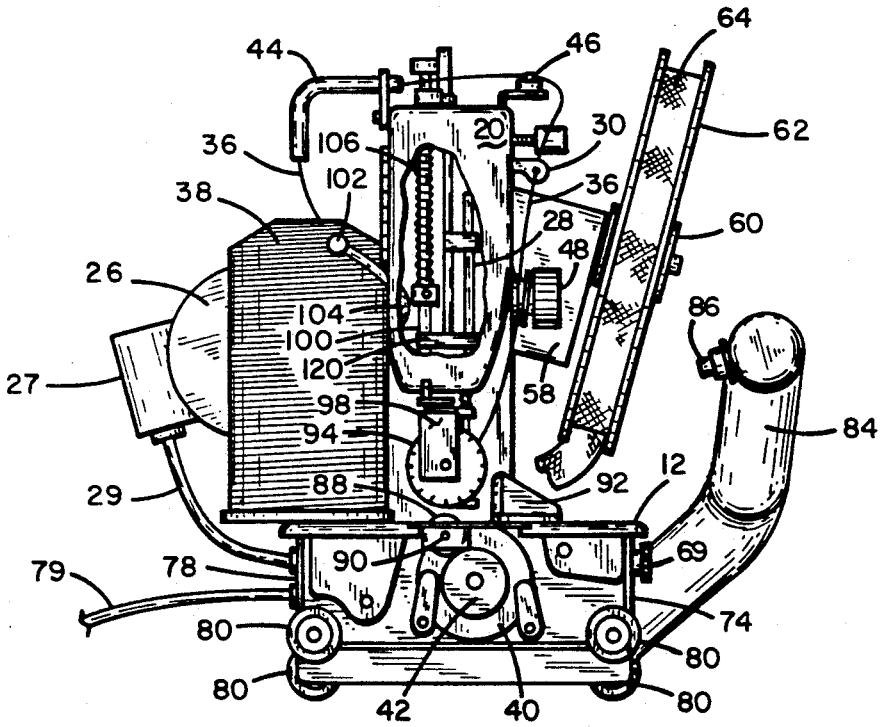
FIG. 2 is an end view taken along the line 2—2 in FIG. 1.

With reference to FIGS. 1 and 2, it can be seen that there is affixed to the housing 14 a bracket 58, and extending from that bracket is a reel mount assembly 60 which supports a reel 62 of flat binding tape 64. The tape is arranged to leave the reel 62 near its bottom where it passes through an undulating wire guide 66 before entering a former 68. The former is configured to cause the strip of tape or ribbon 64 to be folded along a longitudinal midline and then laid over the cut edge of the carpeting (not shown) before passing beneath the needle assembly 18.

Secured to the undersurface of the baseplate 12 by thumb screws 69 is a pan-shaped base 70 having a bottom plate 72 and three mutually perpendicular side walls 74, 76 and 78. On each of the four corners of the base 70 are axle-mounted wheels 80 which allow the machine 10 to roll along the floor 82 during use. The pan-shaped base 70 acts as a cover, shielding the rotary hook drive mechanism (not shown) from damage incident to rough handling and for preventing lubricating oil/grease on the working parts from brushing against the carpeting being bound and causing possible soiling thereof.

With reference to FIG. 1, it can be seen that a round tubular handle 84, which is somewhat L-shaped, is affixed to the pan-shaped base at the rear corner 85 thereof, and it extends outwardly from the side 74 and is inclined upwardly at a predetermined angle in the range of from 0° to 65° and preferably about 22°. An electrical on/off push-button switch 86 is mounted on the handle and can be used by the operator to control the energization of the drive motor 26. The handle 84, being affixed to the rear corner of the base and extending at the desired angle to the horizontal, also allows the operator to more readily steer the machine along the carpet edge as it stitches the binding tape 64 to the carpet edge.

FIG. 2 reveals that there is an idler roller 88 journaled for rotation on an axle 90 located below the baseplate 12 and that a portion of the roller 88 protrudes through a rectangular opening formed in the insert 91 of baseplate 12. This idler roller is adapted to engage the backing side of the carpeting a short predetermined distance inward from the carpet edge as that edge is fed beneath the needle assembly 18 and through the carpet guide 92 disposed at the downstream end of the binding tape former 68. The idler roller 88 replaces the conventional feed dogs of the prior art Newark Caplan machine, those feed dogs being saw-toothed plates which are driven intermittently with rods and linkages to move them intermittently both up and down and from side to side. Because the feed dogs cut and abrade certain carpet backing materials, their elimination through the substitution of a smooth pinch roller eliminates the problem.

Cooperating with the idler roller 88 is a longitudinally grooved drive roller 94. Roller 94 is journaled for rotation about an axle 96 supported by a U-shaped drive roller bracket, which is clamped to the lower end of a lever and cam-operated lift rod 100, the lever and cam being identified by numerals 102 and 104, respectively. As the lever 102 is raised to the position indicated, the cam lifts the rod 100 against the force of a compression spring 106 to raise the roller 94 away from the idler roller 88. Likewise, when the lever 102 is pushed down from the position shown, the spring 106 urges the drive roller assembly downward towards the idler roller 88 and against the pile or nap side of the carpeting. To maintain the axis of the drive roller 96 parallel to the axis of the idler roller 90, a support plate 108 (FIG. 3) is attached to the underside of the machine arm 16 and it has drilled therethrough a small circular aperture through which a guide pin 110 affixed to the bracket 98 passes. Thus, while the drive roller assembly is cantilevered from the lower end of the shaft 100, the plate 108 and the pin 110 insure that the drive roller 94 will not cant when loaded against the pile side of the carpet.

The drive roller 94 is arranged to be driven intermittently and in synchronism with the up and down movement of the needle 32 by way of a flexible drive shaft 112. More particularly, the drive mechanism (not shown), which is arranged to rotate the shaft 112, only turns that shaft at the point in the cycle in which the needle bar is elevated to the point where the needle no longer penetrates the materials being sewn together.

Important to the present invention is the placement of the drive roller 94 relative to the needle 32. Rather than being centered laterally with the needle on the downstream side thereof, in accordance with the present invention, the axis 96 of the drive roller is only slightly offset laterally downstream from the axis of the needle bar 28 about ½ inch, that distance being just sufficient to allow the flexible drive shaft 112 to clear the path of travel of the needle assembly 18. Further, the drive roller 94 is displaced a predetermined distance forward of the needle 32, that distance assuring that when the carpet edge is being guided against the carpet guide 92, the drive roller 94 will be inset sufficiently far to totally engage the carpet material pinched between it and the idler roller 88 and will not partially overlay the edge. This insures that the carpet material will be firmly gripped by the serrated drive roller 94 and there will be little tendency for the roller 94 to walk off of the edge of the carpet.

Figure 4:
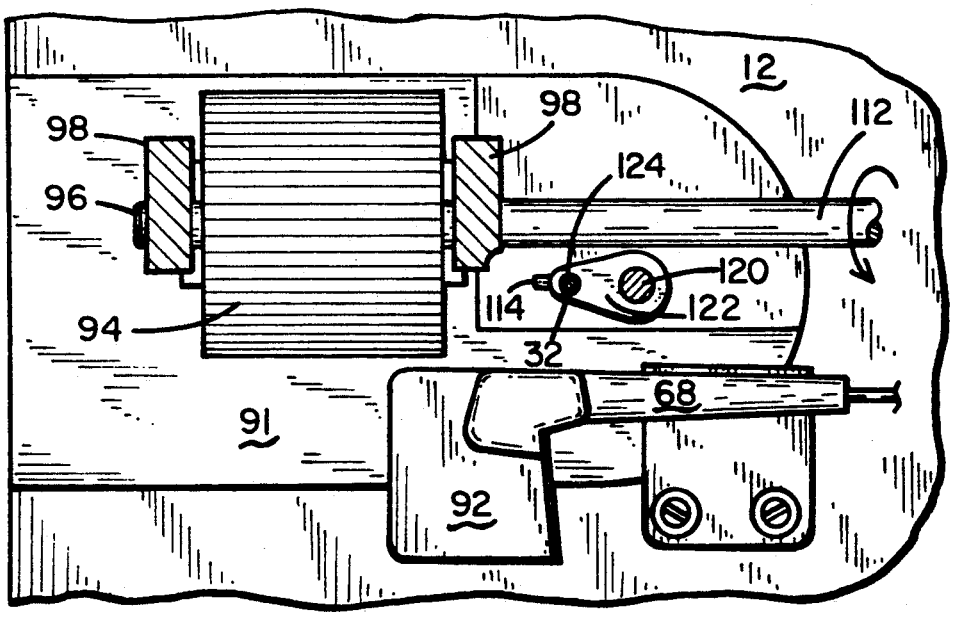
FIG. 4 is a cross-sectional view taken along the line 4—4 in FIG. 3.

The problem of undue needle breakage is obviated in the present invention by providing a needle guide which prevents the needle from being deflected to the point where its tip becomes misaligned with the opening 114 in the baseplate insert 91 through which it is supposed to pass. This needle guide assembly is best seen in the enlarged views of FIGS. 3 and 4. As illustrated, the cylindrical needle bar 28 passes through a circular hole formed in a plate 116 and a compression spring 118 presses against the upper surface of the plate 116 and the underside of a lug 120 (FIG. 2) to normally urge the plate 116 downward against the guide bearing 56. Affixed to the underside of the plate 116 and extending perpendicularly downward therefrom is a cylindrical leg 120 having a footplate 122 attached to it. The footplate 122 has a small circular opening 124 formed through its thickness dimension for allowing the needle 32 to reciprocate up and down through that opening Because of the close tolerance between the wall defining the opening 124 and the outer surface of the needle 32, the needle 32 is precluded from deflecting to the side should it hit a hard object, such as a glue bead or the like, within the carpet material being sewn. The length of the leg 120 is such that the foot 122 comes into firm abutting engagement with the binding tape and carpet above plate 126 affixed to the baseplate insert 91, just as the point of the needle 32 begins to enter the opening 114. This clamps the binding tape to the carpet's edge just as the stitches are being applied. Because the guide bearing 56 is free to slide vertically about the leg 120, the needle can continue its downward 10 movement to the point where it carries its thread so that it can be engaged by the rotary hook 40. On the upward stroke of the needle bar 28, the guide bearing 56 will engage the undersurface of the plate 116 and will lift that plate against the force exerted by the spring 118 so that the rotation of the drive roller can move the apparatus 10 along the carpet's edge.

OPERATION

In operation, with the needle 32 in its elevated position, the carpet edge is inserted into the guide 92 and between the now-elevated drive roller and its associated idler roller. The lever 102 will then be lowered to drop the drive roller assembly onto the exposed upper surface of the carpeting just inward of its cut edge to be bound. The binding tape is drawn out of the former 68 and draped in its folded condition over the cut edge of the carpeting. The operator may now manually rotate the flywheel 22 to cause the needle 32 to be lowered and pushed through the binding tape and carpet edge to pick up a first stitch from the bobbin thread. Once the binding tape 64 is initially tacked with a stitch or two to the carpeting edge, the operator may now depress the on/off switch 86 on the handle, causing the motor 26 to drive both the sewing needle assembly and the drive roller 94 in a synchronized fashion. Because the carpeting remains stationary, rotation of the roller 94, in the clockwise direction when viewed in FIG. 2, will cause the binding machine 10 to move along the floor 82 on the rollers 80 as the binding tape is being drawn off from the reel 62 and adhered to the carpet edge by the stitching action of the reciprocating needle assembly. Because the axis of the roller 94 is displaced only slightly downstream of the axis of the needle, the operator is able to steer the machine around a corner more readily than could be accomplished with the prior art Newark Caplan machine. Moreover, because the drive roller is offset to the side of the needle and inward of the carpet edge, the carpet is firmly gripped between the serrated drive roller and the idler roller over their entire lengths, thus inhibiting the tendency of the machine to walk off the edge of the carpet. The handle placement and orientation allows improved control or steering of the machine and less fatigue on the operator.

In that the needle is, at all times, surrounded by the guide plate 122 during its course of travel, it is constrained from deflecting and ultimately breaking.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. In a machine for sewing binding tape to a cut edge of floor carpeting, said carpeting having a pile surface on a backing layer, said machine comprising a supply of fabric binding tape, wheels, and having a baseplate supporting a machine arm on an upper side thereof, said machine arm having a needle assembly mounted therein and a drive motor for reciprocally moving said needle assembly in a generally vertical direction for generating stitches, carpet feeding means for engaging the carpeting to be bound, and means mounted on said baseplate for folding said binding tape over the cut edge of said carpet as said sewing machine is advanced along said edge of said carpet and said stitches are applied to said binding tape and carpet, the improvement wherein:

said feeding means consisting of a driving roller with a longitudinally serrated surface and being driven intermittently by said drive motor through a flexible shaft to engage said pile surface of said carpet and an idler roller for engaging said backing layer to advance said sewing machine along said edge of said carpet, said driving roller being journaled for rotation about an axis offset slightly laterally of an axis of movement of said needle assembly and engages said carpet over an entire length of said roller a predetermined distance inward of said cut edge of said carpeting and out of lateral alignment with said needle assembly.

2. The improvement as in claim 1 wherein said driving roller is raised and lowered relative to said idler roller to respectively unclamp and clamp said carpeting therebetween.

3. The improvement as in claim 1 wherein said needle assembly comprises:

(a) a needle bar having an upper end and a lower end;

(b) a sewing machine needle clamped to said lower end of said needle bar; and (c) a needle guide coupled to move with said needle bar and including a foot member having an aperture therein for receiving said sewing machine needle therethrough and preventing sideways deflection of said sewing machine needle as said needle coacts with said carpeting.

4. The improvement as in claim 3 wherein said needle guide includes spring means operatively coupled between said machine arm and said foot member for resiliently urging said foot member towards said baseplate during a downward stroke of said sewing machine needle.

5. The improvement as in claim 1 and further including:

a pan-shaped base affixed to said baseplate, said pan-shaped base having a generally closed bottom for enclosing an underside of said baseplate and mutually perpendicular side and end walls, and a plurality of wheels journaled for rotation relative to said pan-shaped base for providing a rolling motion to said sewing machine along the floor as said feeding means coacts with said carpet.

6. The improvement as in claim 5 and further including:

a handle affixed to said pan-shaped base for steering said sewing machine.

7. The improvement as in claim 6 wherein said handle extends outwardly from one side wall of said pan-shaped base and at a predetermined upwardly inclined angle to said generally closed bottom.

8. The improvement as in claim 7 and further including a control switch on said handle connected in electrical communication with said drive motor.

* * * * *